US006865840B2

(12) United States Patent
Kanyuck et al.

(10) Patent No.: US 6,865,840 B2
(45) Date of Patent: Mar. 15, 2005

(54) GUN LOADING DEVICE

(76) Inventors: Emil L. Kanyuck, 925 Pleasant Dr., York Haven, PA (US) 17370; Carl J. Winters, Jr., R.D. #6, Box 160, Red Lion, PA (US) 17356

( * ) Notice: Subject to any disclaimer, the term of this patent is extended or adjusted under 35 U.S.C. 154(b) by 0 days.

(21) Appl. No.: 10/455,606

(22) Filed: Jun. 5, 2003

(65) Prior Publication Data

US 2004/0244260 A1 Dec. 9, 2004

(51) Int. Cl.[7] ..... F41C 27/00
(52) U.S. Cl. ..... 42/90; 42/87; 42/89; 42/106
(58) Field of Search ..... 42/87, 89, 90, 42/106

(56) References Cited

U.S. PATENT DOCUMENTS

| | | | | | |
|---|---|---|---|---|---|
| 163,404 | A | * | 5/1875 | Phillips | 42/90 |
| 184,079 | A | * | 11/1876 | Hovis | 42/90 |
| 586,209 | A | * | 7/1897 | Travis | 42/87 |
| 2,508,820 | A | * | 5/1950 | Fraley | 206/3 |
| 3,757,449 | A | * | 9/1973 | Schindler | 42/87 |
| 4,229,897 | A | * | 10/1980 | Snowden | 42/90 |
| 4,442,620 | A | * | 4/1984 | Drake et al. | 42/90 |
| 4,550,517 | A | * | 11/1985 | Mansfield | 42/90 |
| 4,571,873 | A | * | 2/1986 | Houk | 42/90 |
| 4,601,125 | A | * | 7/1986 | Curtis | 42/90 |
| 4,862,623 | A | * | 9/1989 | Delap et al. | 42/90 |
| 5,081,781 | A | * | 1/1992 | Kanyuck et al. | 42/90 |
| 5,182,412 | A | * | 1/1993 | Mazza | 42/90 |
| 6,637,143 | B1 | * | 10/2003 | Wykle | 42/90 |

* cited by examiner

*Primary Examiner*—Michael J. Carone
*Assistant Examiner*—John Richardson
(74) *Attorney, Agent, or Firm*—Law Offices of Royal W. Craig

(57) ABSTRACT

A gun loading device comprising a base member having a socket to receive the muzzle of a firearm to be loaded with a charge of powder and/or a bullet, a storage cylinder provided with a plurality of bores in a circular pattern which receive such charges and is rotatable about a fixed axis attached to the base member, an upper inlet member having an opening through which a plunger is perpendicularly slideable to push, sequentially, the charges of powder in the bores through a discharge opening in the base member, and multiple posts connecting the base and inlet members together, in a non-twistable configuration, with the cylinder being rotatable therebetween. Quick-releasable latch members preferably are used to secure the connecting member respectively to the base and inlet members, as well as render the elements readily disassembled for cleaning, and the preferred material from which the components of the device are formed is synthetic resin, such as "LEXAN" or A.B.F.

8 Claims, 6 Drawing Sheets

GUN LOADING DEVICE

BACKGROUND OF THE INVENTION

1. Field of the Invention

The present invention relates to gun reloading equipment and, more particularly, to a device to facilitate the loading of muzzle-loading firearms with charges of powder and/or bullets or balls with ease, accuracy and dispatch.

2. Description of the Background

In pioneer times, the principal accouterments for the loading of muzzle-loading firearms were a powder horn, a bullet pouch and a ramrod. These relatively crude implements have not entirely been relegated to history because there remain certain gun buffs that still make use of them. However, there are others that, despite a preference for older muzzle-loading firearms, now rely on an array of more sophisticated equipment for the reloading of firearms of that type.

There have been a number of past efforts, beginning in $19^{th}$ century, to develop more convenient devices for the loading of muzzle-loading firearms. For example, U.S. Pat. No. 163,404 to O. D. Phillips, granted in 1875, comprises a multi-bore rotatable cylinder rotatable upon a base having a socket to receive the muzzle of a gun or rifle and an offset plunger to discharge the powder from the bores into the muzzle of the firearm. The patent to C. W. Hovis, U.S. Pat. No. 184,079 issued in 1876, is similar except that no plunger is included.

Beginning in 1980, there has been a resurgence in the development efforts associated with devices to assist with the loading of muzzle-loading firearms. This resurgence is evident from the following series of patents:

U.S. Pat. No. 4,229,897 issued to Snowden in 1980,

U.S. Pat. No. 4,442,620 issued to Drake et al. in 1984,

U.S. Pat. No. 4,550,517 issued to Mansfield in 1985,

U S. Pat. No. 4,571,873 issued to Houk in 1986,

U.S. Pat. No. 4,601,125 issued to Curtis in 1986, and

U.S. Pat. No. 4,862,623 issued to Delap et al. in 1989.

Finally, the present inventors, in U.S. Pat. No. 5,081,781, disclosed a gun loading device having a base with a socket to receive the muzzle of a gun. The base also supports a storage cylinder with a plurality of bores in a circular pattern which receive charges. The cylinder rotates about the base member, and a plunger is pushed perpendicularly, sequentially, through the charges of powder in the bores. All of the elements are readily disassembled for cleaning.

SUMMARY OF THE INVENTION

It is among the several objects of the invention to provide a gun loading device similar to that set forth in U.S. Pat. No. 5,081,781, but with the following additional features:

It is an object to provide a design for a gun loading device which is highly manufacturable, and in which a majority of the component parts can be economically molded and snap-fit together without the need for assembly tools.

It is another object to provide a gun loading device as described above in which the hand-assembled components may be readily disassembled to render the components easily cleanable to remove any powder adhering thereto.

It is another object to provide a gun loading device as described above in which cylinders of various sizes may be substituted to accommodate firearms of various calibers. Specifically, the design includes interchangeable bores and bore collars to accommodate different calibers, and for accurate barrel location and alignment to the rifle bore.

It is another object to provide a gun loading device as described above in which the unit is secured and stabilized by three independent posts.

These and other objects are accomplished by a gun loading device comprising a base member having a socket to receive the muzzle of a firearm to be loaded with a charge of powder and/or a bullet, a storage cylinder provided with a plurality of bores in a circular pattern which receive such charges and is rotatable about a fixed axis attached to the base member, an upper inlet member having an opening through which a plunger is perpendicularly slideable to push, sequentially, the charges of powder in the bores through a discharge opening in the base member, and multiple posts connecting the base and inlet members together, in a non-twistable configuration, with the cylinder being rotatable therebetween.

Other objects, features, and advantages of the present invention will become more apparent to those skilled in the art from the following detailed description of the preferred embodiments and certain modifications thereof.

DESCRIPTION OF THE PREFERRED EMBODIMENTS

Figure 1:
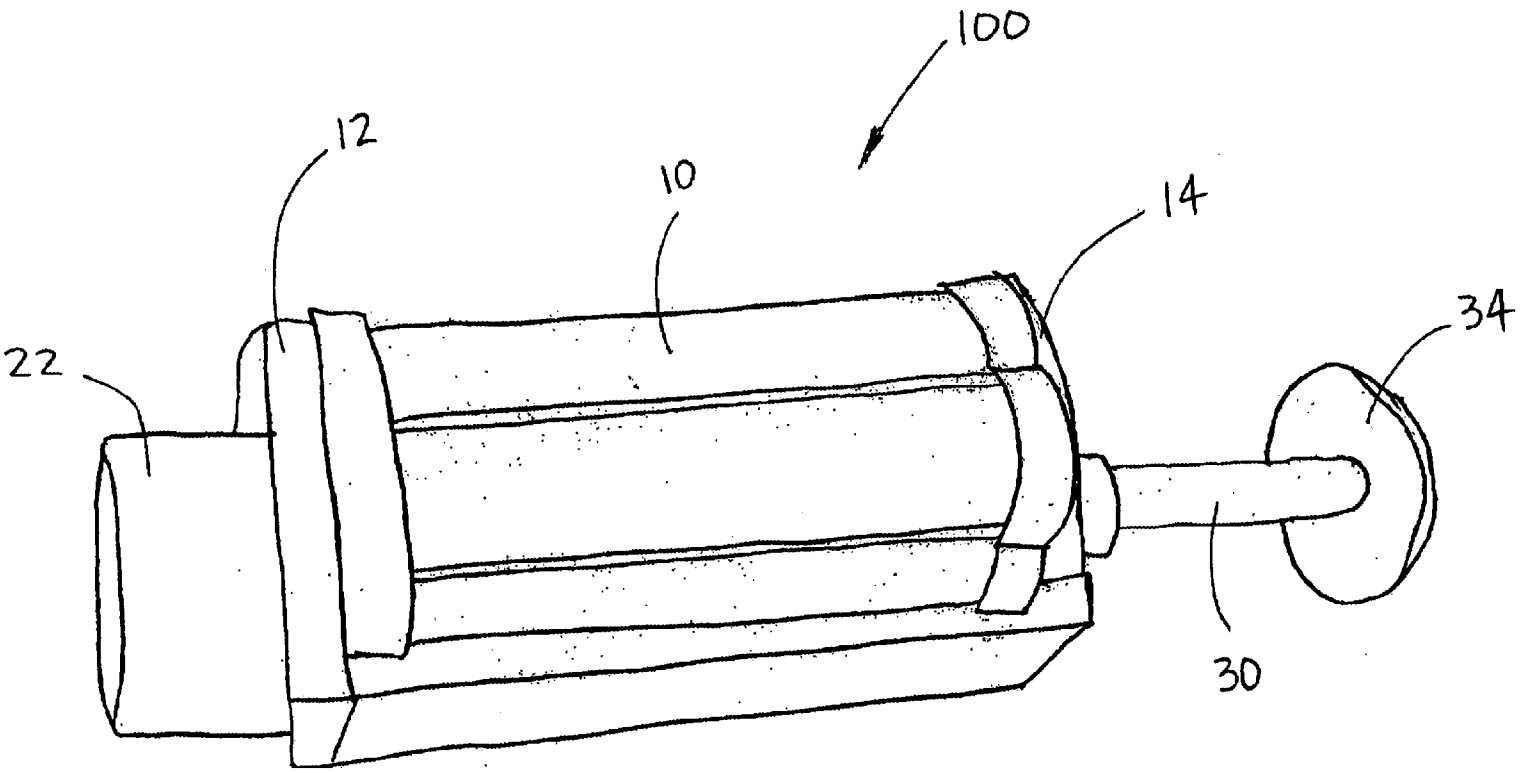
FIG. 1 is a side perspective view of the improved gun loading device 100 according to a first embodiment of the present invention.
Figure 2:
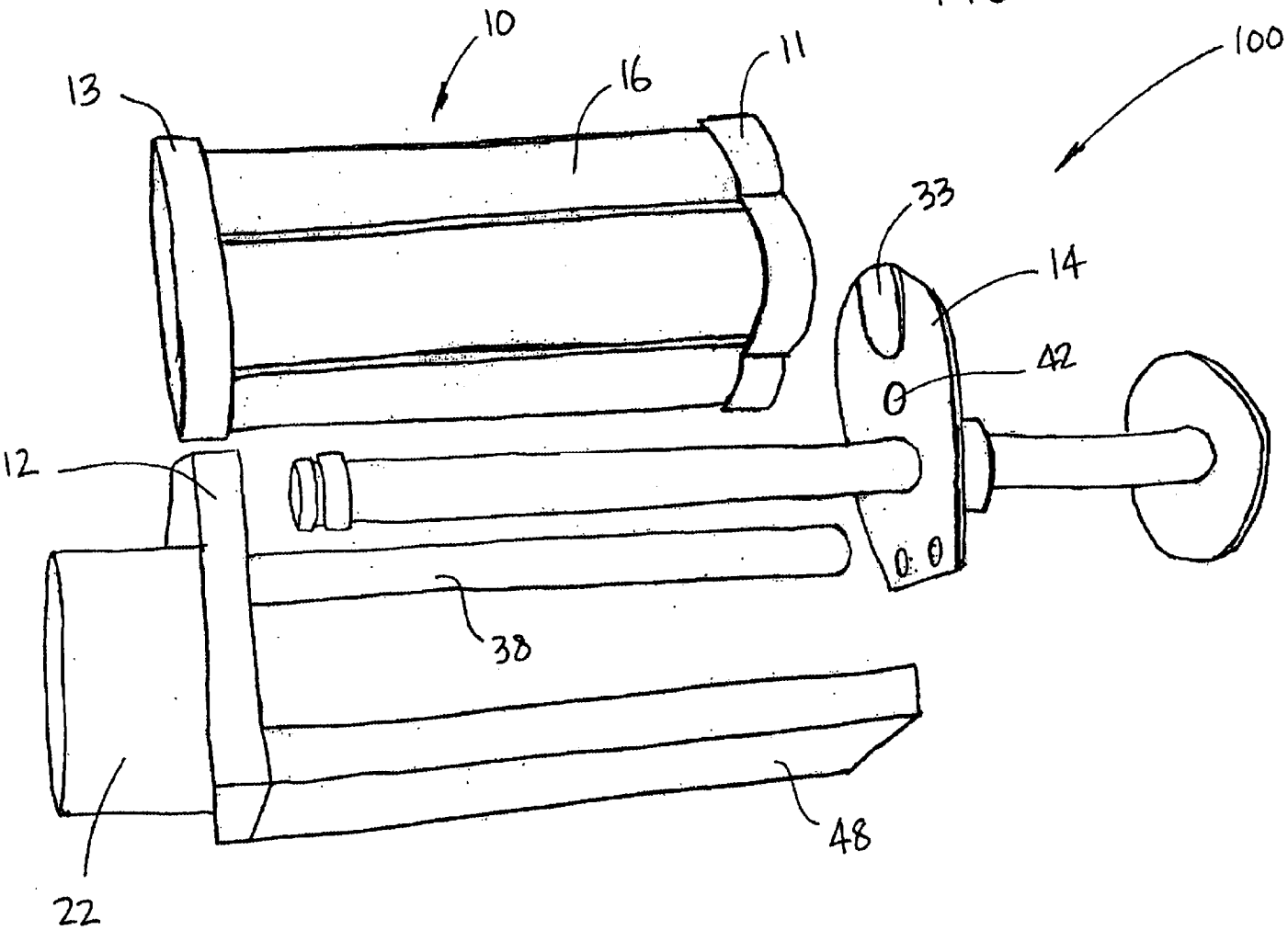
FIG. 2 is an exploded perspective view of the improved gun loading device 100 of FIG. 1 showing its major components.

Referring to FIGS. 1 and 2, the present invention is a gun loading device 100 comprising a cylinder 10 rotatably positioned between a lower base member 12 and an upper inlet member 14.

As best seen in FIG. 2, the cylinder 10 is further comprised of an upper bore collar 11 and lower bore collar 13 which stabilize a plurality of parallel like-sized bores 16. The bore collars 11, 13 are clover-shaped rims which snap-fit around the rims of the parallel bores 16. In accordance with the present invention, a plurality of the cylinders 10 are preferably provided, each sized to accommodate a particular caliber of charge/ball. Thus, for each caliber, a plurality of parallel bores 16 are provided for that particular caliber as well as a matching upper bore collar 11 and lower bore collar 13.

Figure 4:
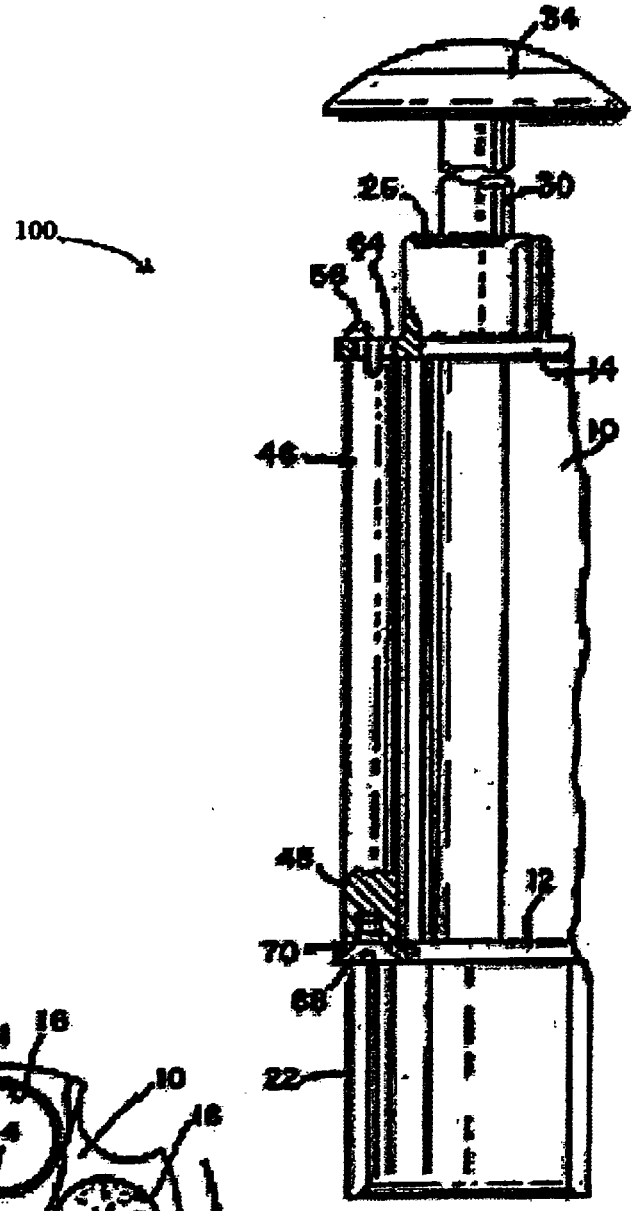
FIG. 4 is a partial vertically-sectioned view of the improved gun loading device 100 of FIG. 1.
Figure 3:
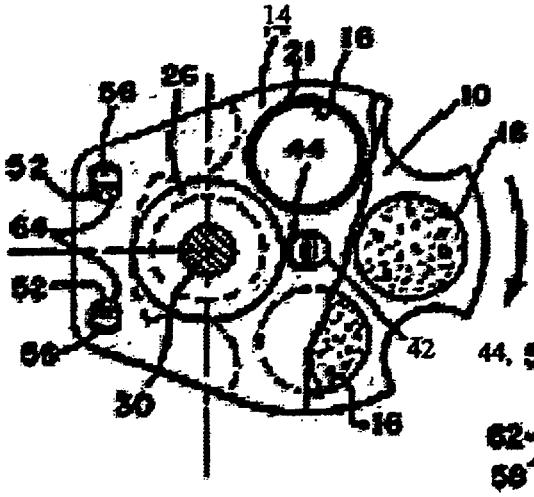
FIG. 3 is a top plan view of the improved gun loading device 100 of FIG. 1 with a portion of the upper inlet member 14 broken away to show details of the elements below.

FIG. 3 is a top plan view, and FIG. 4 is a partial vertically-sectioned view of the improved gun loading device 100 of FIGS. 1 and 2. Each bore 16 is adapted to receive a corresponding measured charge of powder 18 and/or a bullet or ball 20 (see also FIG. 6). One popular example of ball used by shooters of muzzle-loading firearms is sold under the trademark MAXIBALL®. These are constructed in such a way that they have a coating which requires no patch, as is customarily used in muzzle-loading firearms of conventional type.

With collective reference to FIGS. 1–4, the cylinder 10 is rotatably journalled between the lower base member 12 and upper inlet member 14. The inlet member 14 is provided with a filling opening 21, as clearly shown in FIG. 3, through which said charges of powder 18 and balls 20 are loaded successively into the bores 16. The opening 21 is preferably slightly greater in diameter than the bores 16 which register with opening 21 as the cylinder 10 is rotated, as described hereinafter.

Preferably, a cover (not shown) is pivotally attached to upper inlet member 14 for positioning over opening 21 to prevent an inadvertent discharge of the powder 18 and/or the bullet or ball 20 from the bore 16 aligned with the opening 21.

In order to maintain the above-described elements in assembled relationship, the present invention employs three independent stabilizing posts 38, 48, each of which is snap-fit between the upper inlet member 14 and lower base member 12. The two forward stabilizing posts 48 and rear stabilizing post 38 combine to stabilize cylinder 10 and base member 12 with respect to each other and to prevent relative twisting therebetween along the vertical axis. The opposite ends thereof extend respectively through openings 52 in the inlet member 14 and openings 54 in the base member 12.

Figure 5:
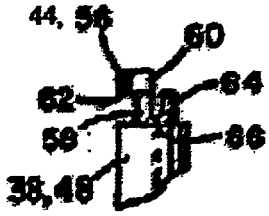
FIG. 5 is an enlarged perspective view of a distal end of post 38, 48.

FIG. 5 is an enlarged perspective view of a distal end of an exemplary post 38, 48. All of the stabilizing posts 38, 48 have distal ends equipped with one or more detent latching members 44, 56, respectively, on opposite ends. One such post 38 is a hollow cylindrical tube that extends through a central bore 40 in the cylinder 10. The lower base member 12 and upper inlet member 14 respectively have holes or bores 42 therein, which respectively receive one of the opposite ends of post 38. It is of considerable importance that the posts 48 effectively prevent relative twisting of the members 12 and 14 about the axis of post 38 (the latter of which is a pivot for the cylinder 10). This arrangement, due to the nature of the posts 48, is completely effective to prevent such relative rotation between the elements 12 and 14. The configuration of posts 38, 48 also facilitates the assembly, and more importantly, facilitates the disassembly of the various elements, especially to effect general cleaning thereof and removal of remaining powder grains or the like, the opposite ends of the stabilizing posts 38, 48, all of which are the same length, are provided with one or more latch members 44, 56, respectively (see FIG. 5). An exemplary latch member 44, 56 is illustrated on one end of one of the posts 38, 48, there is a neck portion 58, which has limited flexibility and a tapered head 60, which terminates at its lower end in a transverse overhang 62 which is adapted to engage one surface of either the lower base member 12 or upper inlet member 14 when the latch member 44, 56 extends through one of the openings 42, 52 in the inlet member 14 or openings 42, 54 in the base member 12. Incidentally, the latch members 44 and 56 are preferably identical in configuration, primarily for purposes of uniformity in molding such latches and the posts with which they are integral. By observing FIG. 5, it readily can be visualized that the neck portion 58 which is thinner than the tapered head 60 enables the same to be flexed sufficiently to disengage the head 60 from the rim of one of said openings 42, 52, 54 and thereby permit the opposite ends of the posts 38, which is a pivot for cylinder 10, or the posts 48 to be unlatched and separated from the openings 42, 52, 54 and disengaged from the lower base member 12 and upper inlet member 14, whereupon all of the major elements comprising the gun loading device 100 of the invention can be separated especially for cleaning purposes. Following such cleaning, they all readily may be reassembled in a very short period of time and stored, if desired, until further use is required. To effect the alignment of the latch members 44, 56 with the respective openings 42, 52, 54 referred to above, each latch member 44, 56 has associated therewith a transversely-spaced stud-like projection 64, which is molded integrally with the post 38, 48 to which it is connected and said stud 64, in each instance, engages an opposite wall of the hole or opening 42, 52, 54 within which the latch member 44, 56 is associated. Thus, the combined latch member 44, 56 and stud-like projection 64 will effect centering of the end of the post 38, 48 upon which the elements are formed within the holes 42, 52, 54 through which said elements project.

The latch members 44, 56 only prevent axial movement when in latched position. Further to seat the necks of the latch members 44, 56 and the stud-like projection 64 within the respective openings in either the lower base member 12 or upper inlet member 14, it will be seen from FIG. 5 that the latch ends of the posts with which they are integral also are provided with an annular transverse shoulder 66 which abuts the surface of the element through which the latch neck 58 and stud 64 extend, whereby such shoulder 66, in conjunction with the transverse overhang 62 firmly secures each end of the various posts 38, 48 to the upper and lower elements 12, 14 between which said posts 38, 48 extend. Preferably, in cross-section, not shown, the neck portion 58 and stud-like projection 64 are circular and correspond to the walls of the openings 42, 52, 54 in the several elements 12, 14 abutting opposite ends of the cylinder 10 and through which they project.

Figure 6:
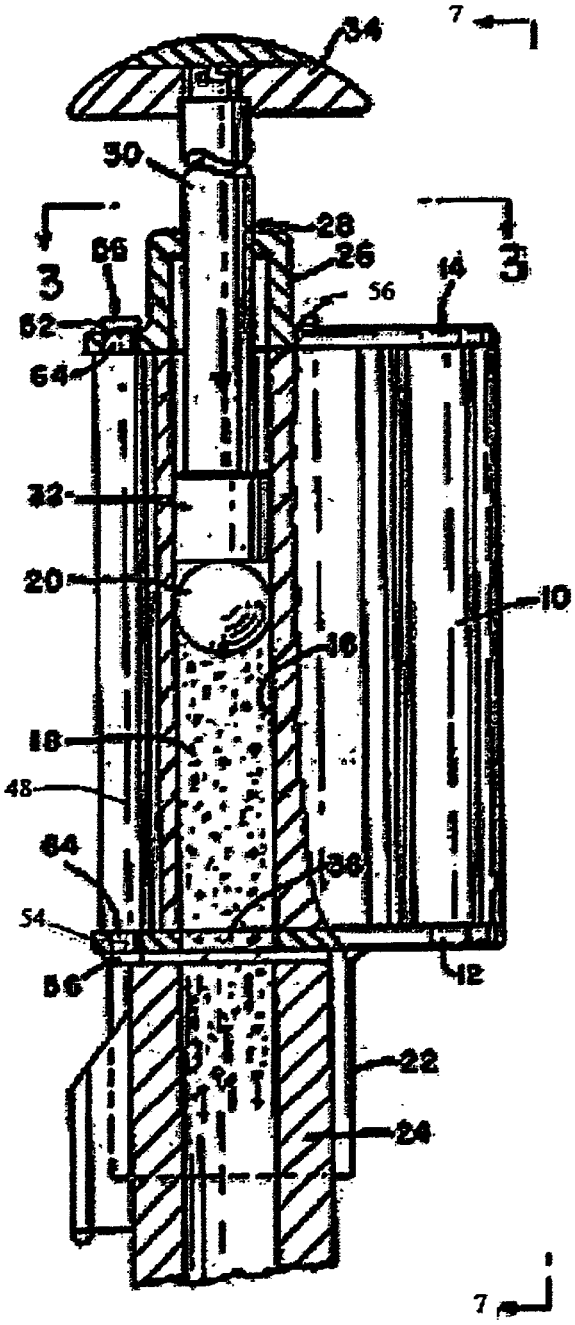
FIG. 6 is a partial vertically-sectioned view of the improved gun loading device 100 of FIG. 1.
Figure 7:
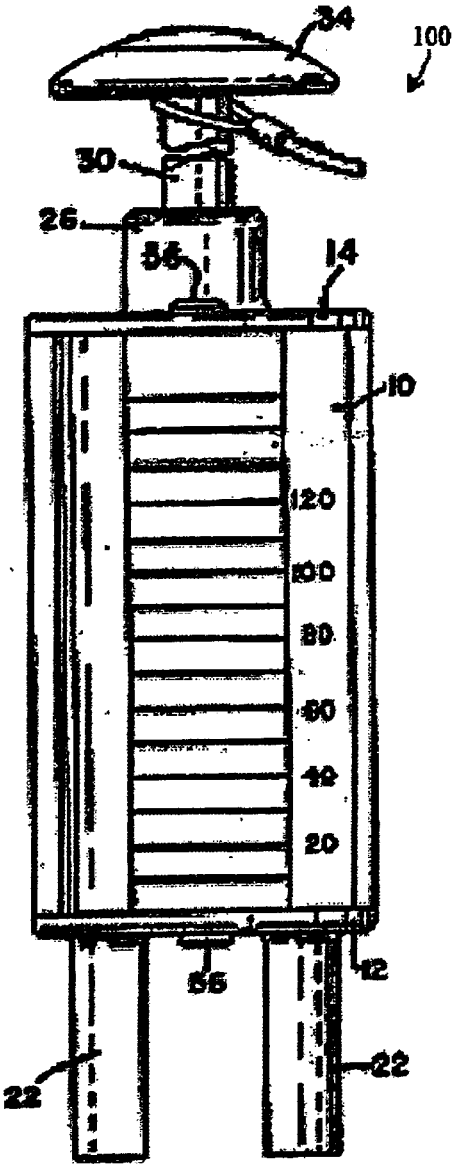
FIG. 7 is a front perspective view of the improved gun loading device 100 of FIG. 1.

FIG. 6 is a side-sectioned view and FIG. 7 is a front perspective view, respectively, of the improved gun loading device 100 of FIGS. 1–5. It can be seen that the gun loading device 100 incorporates a limited number of different elements which are readily connected substantially without the use of tools and, similarly, readily may be disconnected especially for the purpose of cleaning the components to remove any accumulated powder grains or the like and thus, permit the device 100 to be stored between uses thereof and always ready to be used. Between uses, the several bores 16 may remain loaded with charges of powder 18 and/or bullets or balls 20, especially in view of the fact that the lower base member 12 and upper inlet member 14, as shown in FIG. 3, maintain the opposite ends, of the various bores 16 in closed condition. When stored, best practice would indicate that the bore of cylinder 10, which is aligned with plunger 30, would remain unloaded with the plunger 30 extended into the empty bore. This configuration serves to prevent any rotation of the cylinder 10 and minimizes the amount of space/volume required to store the present invention.

Base member 12 is provided with a pair of depending arcuate guide members 22 which define a socket that receives the muzzle end 24 of a firearm, as shown in FIGS. 6 and 7. Guide members 22 are detachably attached to base member 12 such that they are interchangeable, thus enabling the gun loading device 100 to accommodate firearms having different diameter muzzle ends 24.

When the muzzle end 24 of a firearm is seated in the arcuate guide members 22, the material in each of the bores 16 can be discharged into the muzzle of the firearm through a discharge opening 36 in the base member 12. The powder 18 and ball 20 pass through the discharge opening 36 incident to being received in the upper end of the muzzle 24 of the firearm. To facilitate ejection of the powder charge 18 and bullet or ball 20 sequentially from the bore 16 of the cylinder 10, the upper inlet member 14 is provided with an integrally-molded cup-like extension 26 with a constricted bearing opening 28 in the upper end through which a discharge plunger 30 extends. The lower, inner end of the plunger 30 has a piston 32 mounted thereon, which actually engages the ball 20 and that, in turn, engages the powder charge 18. The upper end of plunger 30 is provided with a push-button 34 integrally secured thereto.

Figure 8:
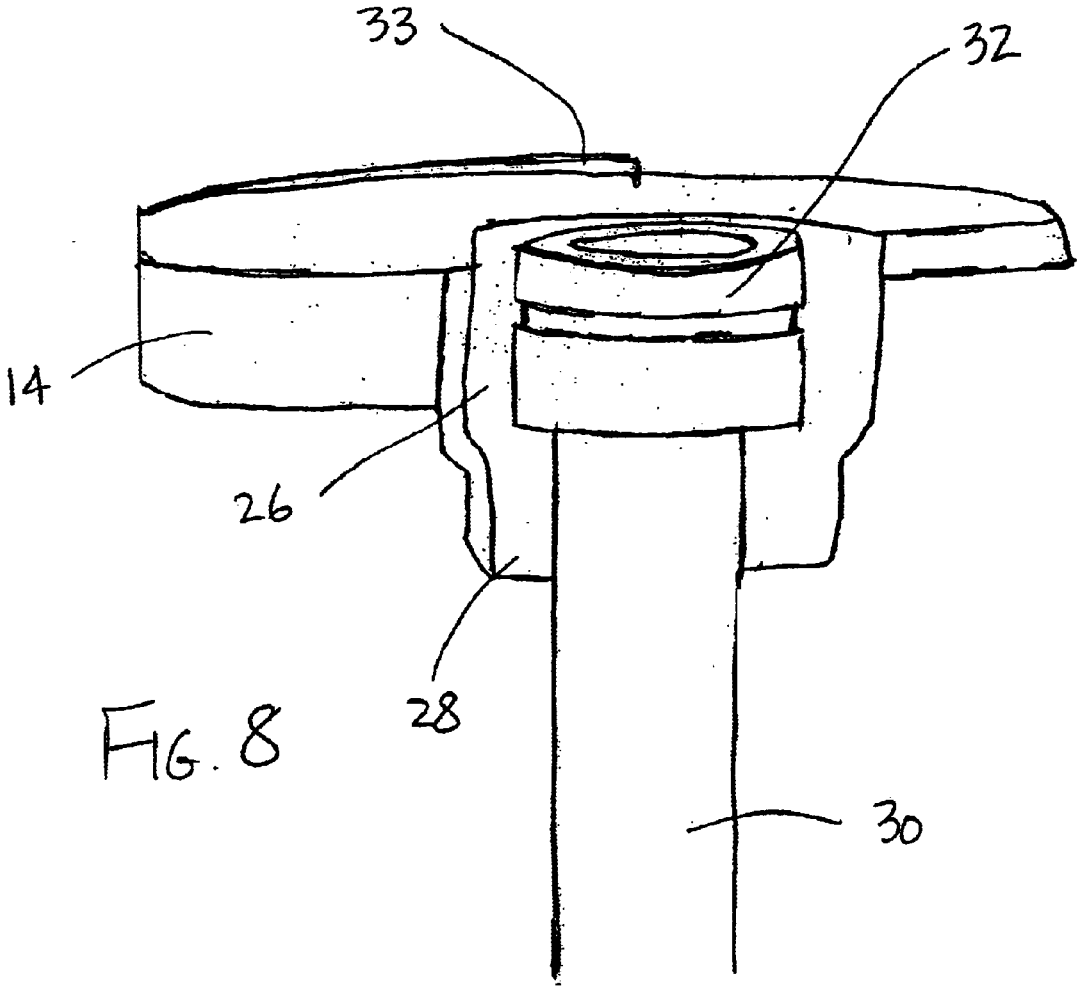
FIG. 8 is an enlarged perspective view of the upper inlet member 14, illustrating how it indexes rotation of the cylinder.
Figure 9:
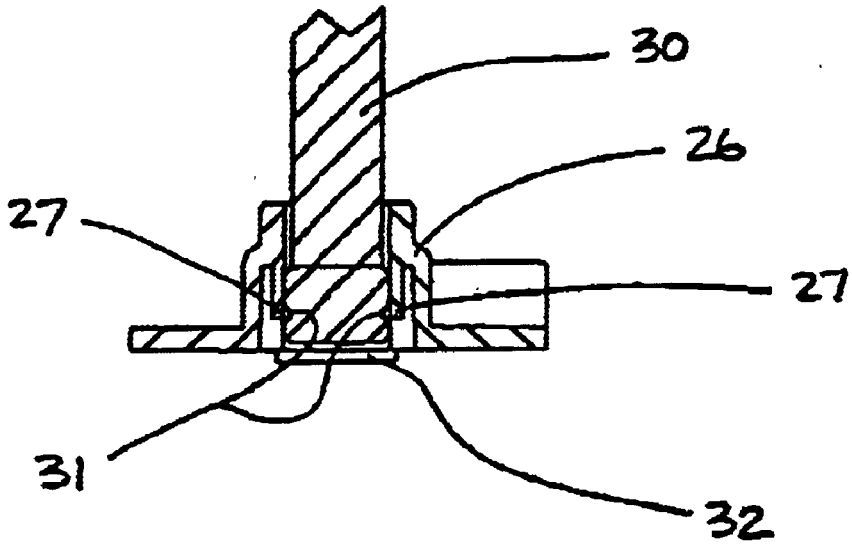
FIG. 9 is an enlarged cross-section of the cup-like extension 26 shown with the plunger 30 and the piston 32 in the fully retracted position.

FIG. 8 is an enlarged perspective view of the upper inlet member 14, and FIG. 9 is a cross-section enlarged view of the cup-like extension 26 shown with the plunger 30 and the piston 32 in the fully retracted position. As best seen in FIG. 9, a latching mechanism 27 holds the plunger 30 in a fully retracted position such that no part of the plunger 30 or piston 32 remain within one of the parallel bores 16. The latching mechanism 27 is positioned within the cup-like extension 26 and engages a circumferential notch 31 cut into the piston 32. Positive force exerted by the user on the push-button 34, along the central axis of the plunger 30, is required to disengage the latching mechanism 27 and effect the discharge of the material in the bore 16.

Also shown in FIG. 8 is a downwardly protruding tab 33 that is indexed to upwardly protruding dimples (not shown in the Figures) around the top of cylinder 10. Tab 33 indexes the cylinder 10 into position, thereby ensuring that the cylinder 10 is rotated into exact alignment between the lower base member 12 and upper inlet member 14 such that the filling opening 21 is exactly aligned with a corresponding bore 16 for loading of the powder 18 and ball 20.

With collective reference to FIGS. 1–9, the preferred embodiment of the gun loading device 100 is assembled via the following series of steps. The stabilizing posts 38, 48 are first attached to the upper inlet member 14. Four parallel bores 16 are snapped into the upper and lower bore collars 11, 13, respectively, to form the cylinder 10. The cylinder 10 is then rotatably attached to the centrally-located stabilizing post 38. The lower base member 12 is then attached to the stabilizing posts 38, 48 to hold the cylinder in position between the upper inlet member 14 and the lower base member 12.

The plunger 30, with the push button 34 detached, is then assembled into the present invention by inserting the end opposite the piston 32 through the discharge opening 36, the bore 16 aligned with the opening 36, and the bearing opening 28 until it emerges through the top of the cup-like extension 26. The push-button 34 is then attached to the plunger 30 making the plunger an integral part of the gun loading device 100. The final assembly step is the attachment of the guide members 22 to the lower base member 12.

To disassemble the present invention, the steps outlined above are reversed.

Use of the gun loading device 100 involves the loading of powder 18 and a bullet or ball 20 into the multiple parallel bores 16 and the transfer of the powder 18/bullet/ball 20 combination into the muzzle 24 of a firearm.

To load the present invention, position the plunger 30 in its fully retracted position (i.e. the latching device 27 is engaged with the notch 31 in the piston 32). Insert the appropriate, pre-measured amount of powder 18, followed by the bullet or ball 20, via the opening 21 in the upper inlet member 14 into the bore 16 aligned with the opening 21. After making sure that bullet/ball 20 is positioned below the lip of the opening 21, the cylinder 10 is rotated 90° (i.e. until the downwardly protruding tab 33 engages the next upwardly protruding dimple on the top of the cylinder 10) to align an empty bore 16 with the opening 21. These steps are repeated until three of the four bores 16 are loaded with powder 18 and a bullet/ball 20. The empty, fourth bore is that aligned with the discharge opening 36 and the plunger 30. The plunger 30 may then be extended into the empty bore 16 to prevent inadvertent turning of the cylinder 10 resulting in the discharge of the contents of a loaded bore 16.

To transfer the contents of a bore 16 to the muzzle 24 of a firearm, the plunger 30 is first fully retracted from the empty bore 16 to enable the turning of the cylinder 10. The gun loading device 100 is then positioned over the muzzle 24 of a firearm utilizing the guide members 22 to align the discharge opening 36 with the muzzle opening. The cylinder 10 is then rotated to align a loaded bore 16 with the discharge opening 36. Once the proper alignment of the bore 16, the opening 36, and the muzzle 24 is established, gravity will generally cause the powder 18 to fall into the muzzle 24 of the firearm. The bullet/ball 20 is then transferred, along with any remaining powder 18, into the muzzle 24 of the firearm by extending the plunger 30 into the bore 16. The same firearm may be reloaded, or another one loaded, by repeating the above steps until each of the bores 16 are empty.

While it is preferred that the members 12 and 14 be secured to the several posts 38, 48 of the device 100 by latch means as described above, especially to assist in loading the bores 16 with powder 18 and bullets or balls 20, as shown in FIG. 4, the ends of posts 48 which engage base member 12, may be attached thereto by screws 68 which extend through beveled holes 70 in said base member 12. Under such circumstances, the inlet member 14 may be unlatched from said posts 38, 48, thus exposing the upper ends of the bores 16 for ready-loading with powder 18 and/or bullets or balls 20. Also, to assist in loading the bores 16, at least the cylinder 10 may be molded from transparent resin.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. A gun loading device operable to charge a gun with at least one of powder or a projectile, comprising:

a cylinder including a plurality of parallel bores each adapted to receive a measured charge of at least one of powder or a projectile, and upper and lower bore collars for parallel alignment and stabilization of said bores;

a lower base member having a guide for positioning said device upon said gun's muzzle, said lower base member also having a discharge opening alignable with said guide through which charges are dispensed into the muzzle of said gun;

an upper inlet member having an inlet aperture for admitting charges into the parallel bores of said cylinder, said cylinder being rotatably mounted between said upper inlet member and said lower base member;

a plunger perpendicular operatively seated in said upper inlet member for pushing said charges out of said bores and through the discharge opening in said lower base member into the muzzle of said gun;

a plurality of stabilizing posts extending between said lower base and upper inlet members to secure said lower base and upper inlet members in a spaced relation with said cylinder rotatably mounted there between.

2. The gun loading device according to claim 1 wherein said plunger is slideably seated in said upper inlet member.

3. The gun loading device according to claim 2 further comprising retention means to maintain said plunger in a fully retracted position, whereby rotation of said cylinder is unimpeded by said plunger.

4. The gun loading device according to claim 1 further comprising locating means to ensure proper alignment between any one of said plurality of parallel bores and said discharge opening in said lower base member.

5. The gun loading device according to claim 1 further comprising locating means to ensure proper alignment between any one of said plurality of parallel bores and said inlet aperture in said upper inlet member.

6. The gun loading device according to claim 1 wherein said guide is detachably attached to said lower base member.

7. The gun loading device according to claim 1 wherein said cylinder is detachably mounted between said upper inlet member and said lower base member.

8. The gun loading device according to claim 1 further comprising three stabilizing posts.

* * * * *